US011385589B2

(12) United States Patent
Uohashi et al.

(10) Patent No.: US 11,385,589 B2
(45) Date of Patent: Jul. 12, 2022

(54) IMAGE FORMING APPARATUS WITH DETACHABLE DRUM UNIT AND DEVELOPING UNIT

(71) Applicant: KYOCERA Document Solutions Inc., Osaka (JP)

(72) Inventors: Yuki Uohashi, Osaka (JP); Rei Yamagishi, Osaka (JP); Hironori Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/354,796

(22) Filed: Jun. 22, 2021

(65) Prior Publication Data

US 2021/0397121 A1 Dec. 23, 2021

(30) Foreign Application Priority Data

Jun. 23, 2020 (JP) ..... JP2020-107822
Jun. 23, 2020 (JP) ..... JP2020-107823
Jun. 23, 2020 (JP) ..... JP2020-107824

(51) Int. Cl.
*G03G 21/16* (2006.01)
*G03G 15/08* (2006.01)
*G03G 21/18* (2006.01)

(52) U.S. Cl.
CPC ..... *G03G 21/1647* (2013.01); *G03G 15/0822* (2013.01); *G03G 21/1676* (2013.01); *G03G 21/1821* (2013.01); *G03G 21/1853* (2013.01)

(58) Field of Classification Search
CPC ..... G03G 15/0822; G03G 21/1647; G03G 21/1676; G03G 21/1821; G03G 21/1842; G03G 21/1853; G03G 2221/1651; G03G 2221/1853
See application file for complete search history.

(56) References Cited

U.S. PATENT DOCUMENTS 9,383,720 B1 * 7/2016 Fukamachi ..... G03G 21/1821
10,175,628 B1 * 1/2019 Sato ..... G03G 21/1853
(Continued)

FOREIGN PATENT DOCUMENTS

EP 0527422 A2 * 2/1993
JP 2006259233 A 9/2006

*Primary Examiner* — Sophia S Chen
(74) *Attorney, Agent, or Firm* — Alleman Hall Creasman & Tuttle LLP

(57) ABSTRACT

An image forming apparatus includes an apparatus main body, a drum unit, and a developing unit. The developing unit includes a developing unit projection projecting out from opposite sides of the developing unit along an extension line of a rotation shaft of a developing roller. The apparatus main body includes a first developing projection guide portion configured to guide the developing unit projection from a first start position to a relay position in the apparatus main body, the relay position located closer to the photoconductor drum than the first start position. The drum unit includes a second developing projection guide portion configured to, succeeding from the first developing projection guide portion, guide the developing unit projection from the relay position to a first end position, the first end position located closer to the photoconductor drum than the relay position.

9 Claims, 8 Drawing Sheets

(56) References Cited

U.S. PATENT DOCUMENTS

| | | | | |
|---|---|---|---|---|
| 2007/0071483 | A1* | 3/2007 | Kamimura | G03G 21/1871 399/90 |
| 2008/0240774 | A1* | 10/2008 | Fukamachi | G03G 15/0865 399/111 |
| 2015/0277362 | A1* | 10/2015 | Yokoi | G03G 21/1676 399/119 |
| 2015/0277368 | A1* | 10/2015 | Nishiyama | G03G 21/1814 399/111 |
| 2018/0299823 | A1* | 10/2018 | Uyama | G03G 21/1821 |
| 2019/0179259 | A1* | 6/2019 | Sato | G03G 21/1821 |

* cited by examiner

IMAGE FORMING APPARATUS WITH DETACHABLE DRUM UNIT AND DEVELOPING UNIT

INCORPORATION BY REFERENCE

This application is based upon and claims the benefit of priority from the corresponding Japanese Patent Applications No. 2020-107824 filed on Jun. 23, 2020, No. 2020-107822 filed on Jun. 23, 2020 and No. 2020-107823 filed on Jun. 23, 2020, the entire contents of which are incorporated herein by reference.

BACKGROUND

The present disclosure relates to an image forming apparatus including a drum unit and a developing unit that are each attached in a detachable manner.

An electrophotographic image forming apparatus may include a drum unit and a developing unit that are each attached, in a detachable manner, to an apparatus main body. The drum unit includes a photoconductor drum and the developing unit includes a developing roller that supplies developer to the surface of the photoconductor drum.

For example, there is known an image forming apparatus in which the apparatus main body includes a guide portion that guides the drum unit and the developing unit respectively to predetermined attachment positions.

SUMMARY

An image forming apparatus according to an aspect of the present disclosure includes an apparatus main body, a drum unit, and a developing unit. The apparatus main body has an opening that is closed by a cover portion. The drum unit includes a rotatably supported photoconductor drum and is attached through the opening to an inside of the apparatus main body in a detachable manner. The developing unit includes a rotatably supported developing roller and a developing unit projection and is attached to the drum unit in a detachable manner. The developing unit projection is formed to project out from opposite sides of the developing unit along an extension line of a rotation shaft of the developing roller. The apparatus main body includes a first developing projection guide portion configured to guide the developing unit projection from a first start position to a relay position in the apparatus main body, the relay position located closer to the photoconductor drum than the first start position. The drum unit includes a second developing projection guide portion configured to, succeeding from the first developing projection guide portion, guide the developing unit projection from the relay position to a first end position, the first end position located closer to the photoconductor drum than the relay position.

An image forming apparatus according to another aspect of the present disclosure includes a drum unit, a developing unit, and a biasing mechanism. The drum unit is provided in an apparatus main body and includes a rotatably supported photoconductor drum. The developing unit includes a rotatably supported developing roller, a primary gear, and a secondary gear and is configured to be attached to the drum unit. The primary gear receives a rotational force from a drive portion provided in the apparatus main body. The secondary gear is integrally provided with a rotation shaft of the developing roller and receives a rotational force from the primary gear. The biasing mechanism elastically biases the developing unit toward the photoconductor drum. The developing unit includes a first developing unit projection and a second developing unit projection. The first developing unit projection is formed to project out from opposite sides of the developing unit along an extension line of a rotation shaft of the developing roller. The second developing unit projection is provided on an opposite side to the first developing unit projection with respect to the primary gear in a state where the developing unit has been attached to the drum unit. The second developing unit projection is formed to project out from the opposite sides in parallel to the first developing unit projection. The drum unit includes a first support surface and a second support surface. The first support surface supports the first developing unit projection against a moment of a force that is applied from the primary gear to the developing unit via the secondary gear, the first support surface being parallel to a biasing direction of the biasing mechanism. The second support surface supports the second developing unit projection against the moment of the force, the second support surface being parallel to the biasing direction.

An image forming apparatus according to a still another aspect of the present disclosure includes an apparatus main body, a drum unit, and a developing unit. The apparatus main body has an opening that is closed by a cover portion. The drum unit includes a rotatably supported photoconductor drum and is attached through the opening to the apparatus main body in a detachable manner. The developing unit includes a rotatably supported developing roller and is attached to the drum unit in a detachable manner. The drum unit forms an attachment space in which the developing unit is disposed, and includes a handle portion configured to be gripped by a hand that accesses the handle portion through the attachment space. By being attached to the drum unit, the developing unit closes a path including the attachment space through which the handle portion is accessed by the hand.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Entire Configuration of Image Forming Apparatus 10]

An image forming apparatus 10 according to the embodiment executes a print process by an electrophotographic method. The print process is executed to form an image on a sheet.

Figure 1:
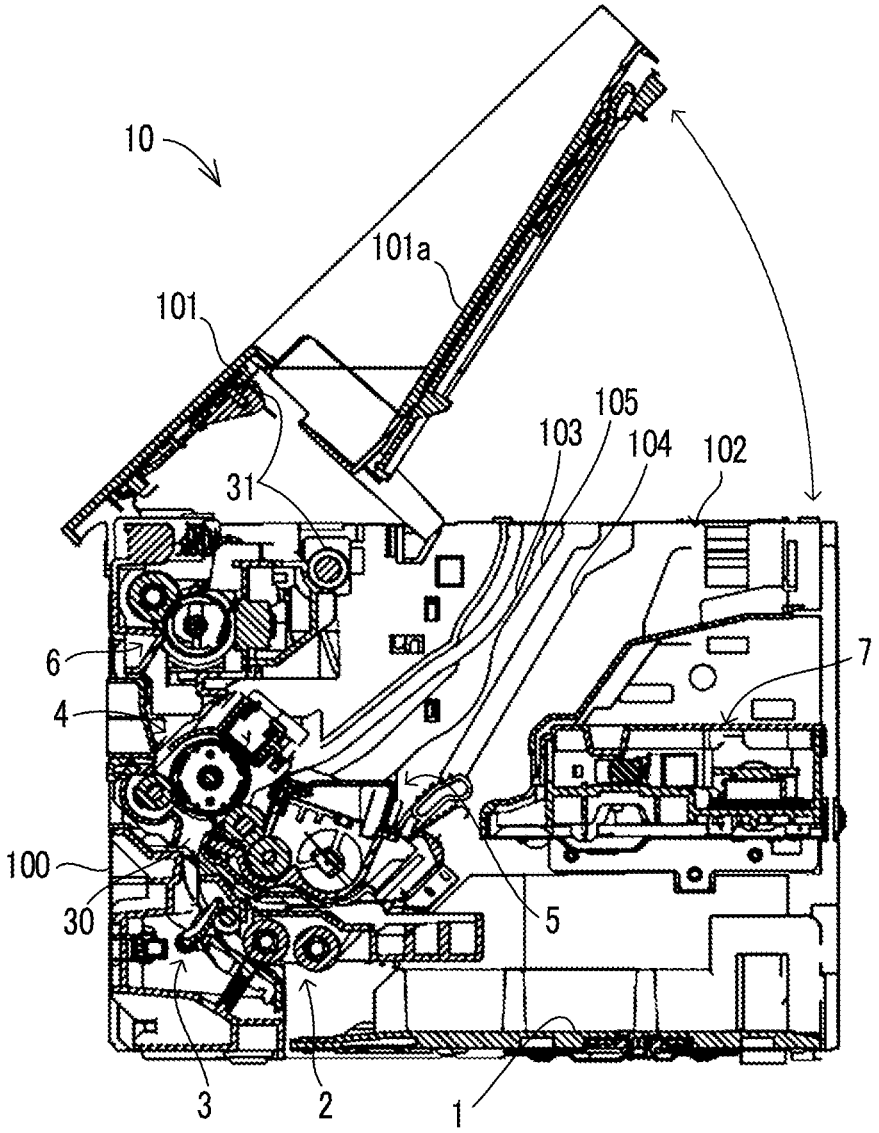
FIG. 1 is a cross-section diagram of an image forming apparatus according to an embodiment.

As shown in FIG. 1, the image forming apparatus 10 includes an apparatus main body 100 and a cover portion 101, wherein a main opening 102 is formed in an upper portion of the apparatus main body 100, and the cover portion 101 closes the main opening 102. The cover portion 101 is configured to open and close the main opening 102. The cover portion 101 is supported by the apparatus main body 100 in such a way as to pivot vertically.

The apparatus main body 100 is a main housing storing a sheet cassette 1, a sheet feed device 2, a sheet conveying device 3, a drum unit 4, a developing unit 5, a fixing device 6, and an exposure device 7.

A plurality of sheets are stacked in the sheet cassette 1. The sheet feed device 2 feeds the sheets stacked in the sheet cassette 1 one by one to a sheet conveyance path 30. The sheet conveying device 3 includes a plurality of pairs of conveyance rollers 31 that convey the sheet along the sheet conveyance path 30. The sheet conveying device 3 discharges the sheet with an image formed thereon, from the sheet conveyance path 30 to a discharge tray 101*a*. The discharge tray 101*a* is formed in the cover portion 101 (see FIG. 1).

Figure 5:
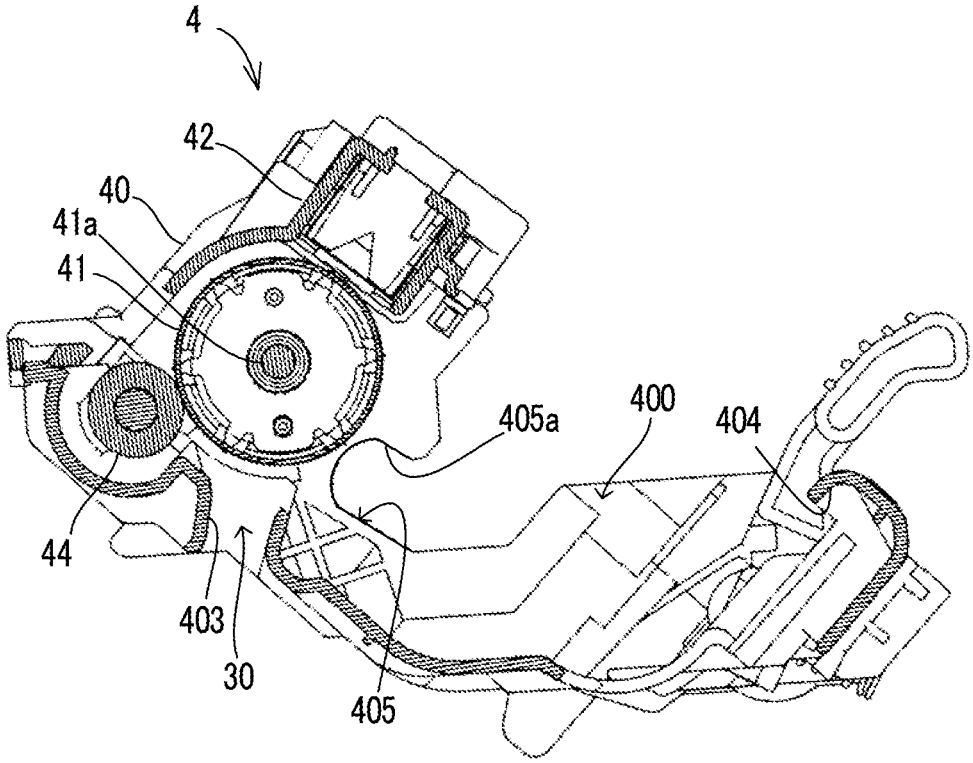
FIG. 5 is a cross-section diagram of the drum unit in the image forming apparatus according to the embodiment.
Figure 6:
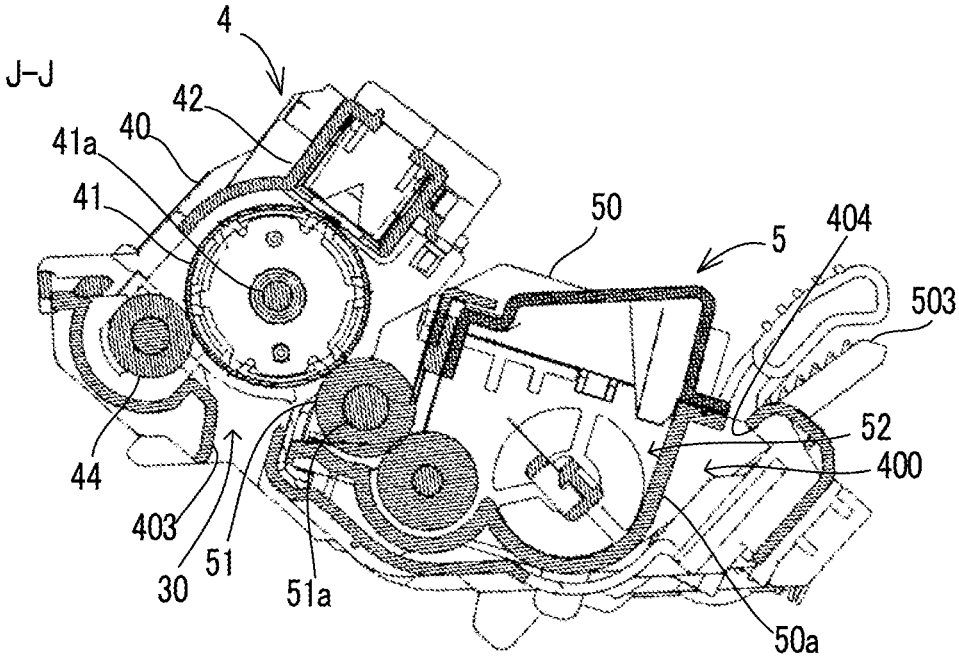
FIG. 6 is a first cross-section diagram of the drum unit and the developing unit in the image forming apparatus according to the embodiment.
Figure 7:
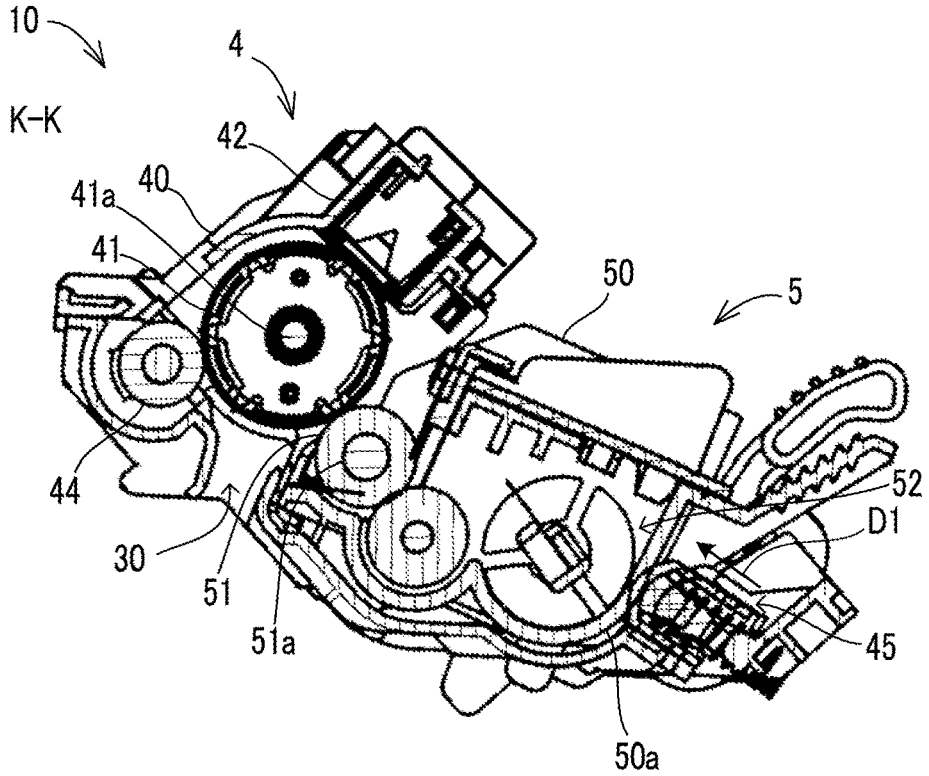
FIG. 7 is a second cross-section diagram of the drum unit and the developing unit in the image forming apparatus according to the embodiment.

As shown in FIG. 5 to FIG. 7, the drum unit 4 includes a first unit housing 40, a photoconductor drum 41, a charging device 42, and a transfer roller 44. The first unit housing 40 supports the photoconductor drum 41, the charging device 42, and the transfer roller 44.

Figure 4:
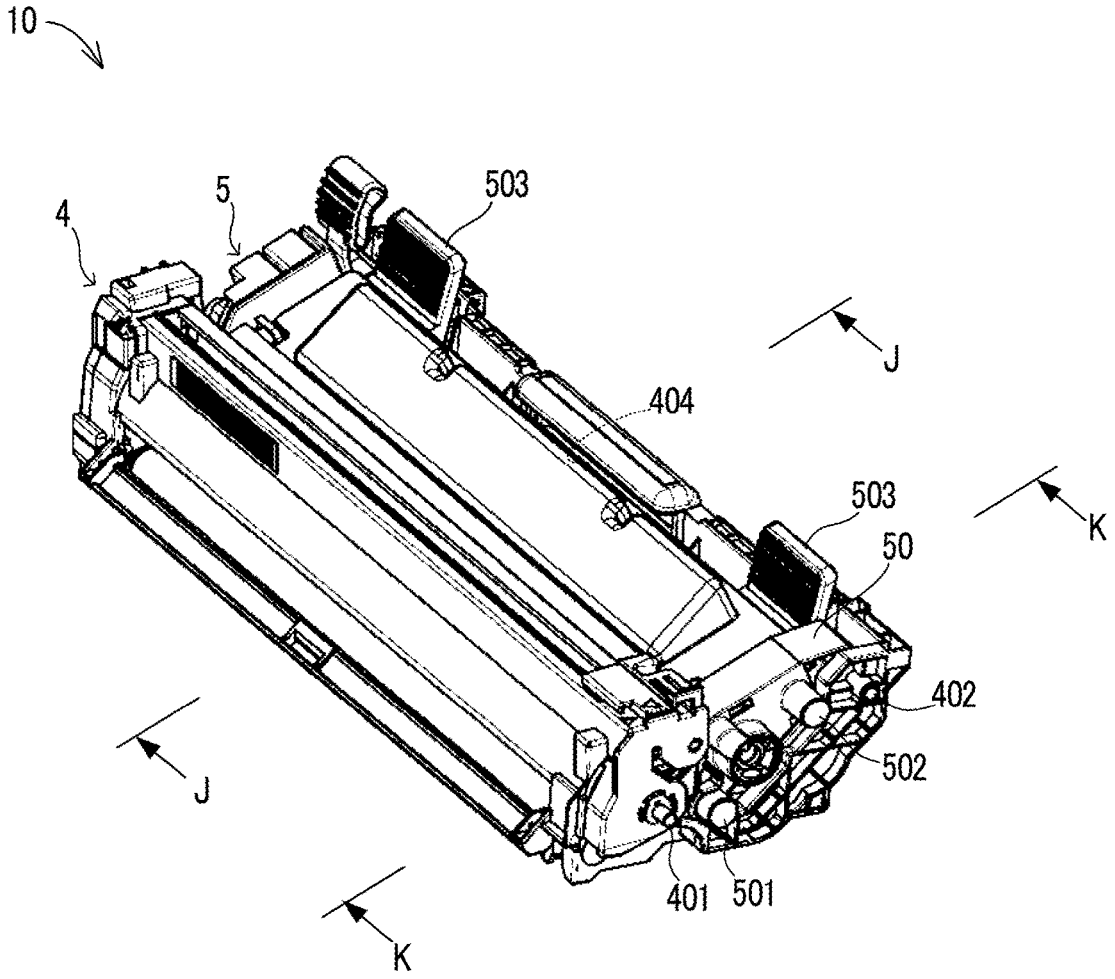
FIG. 4 is a perspective diagram of the drum unit and the developing unit in the image forming apparatus according to the embodiment.

FIG. 6 is a cross-section diagram of the drum unit 4 and the developing unit 5 taken along a J-J plane shown in FIG. 4. In addition, FIG. 7 is a cross-section diagram of the drum unit 4 and the developing unit 5 taken along a K-K plane shown in FIG. 4.

The photoconductor drum 41 and the transfer roller 44 are rotatably supported by the first unit housing 40. The photoconductor drum 41 is rotatably supported by a rotation shaft 41*a*, and the rotation shaft 41*a* is supported by the first unit housing 40.

The charging device 42 electrically charges the surface of the photoconductor drum 41. The exposure device 7 writes an electrostatic latent image on the surface of the photoconductor drum 41. The electrostatic latent image is developed as a toner image by the developing unit 5.

The transfer roller 44 transfers the toner image from the photoconductor drum 41 to the sheet. The first unit housing 40 includes a sheet introducing portion 403 that guides the sheet to a transfer position between the photoconductor drum 41 and the transfer roller 44 (see FIG. 5, FIG. 6).

As shown in FIG. 6 and FIG. 7, the developing unit 5 includes a second unit housing 50 and a developing roller 51. The second unit housing 50 includes a developer case 50*a* that stores toner.

The second unit housing 50 rotatably supports the developing roller 51. Specifically, the developing roller 51 is integrally provided with a rotation shaft 51*a*, and the rotation shaft 51*a* is rotatably supported by the second unit housing 50.

The developing roller 51 supplies the toner in the developer case 50*a* to the surface of the photoconductor drum 41, thereby developing, as a toner image, the electrostatic latent image formed on the surface of the photoconductor drum 41. The developing unit 5 also includes a stirring member 52 configured to stir the developer in the developer case 50*a*.

The drum unit 4 and the developing unit 5 are individually attached to the apparatus main body 100. In the present embodiment, the drum unit 4 is attached through the main opening 102 to the inside of the apparatus main body 100 in a detachable manner. In addition, in a state where the drum unit 4 has been attached to the inside of the apparatus main body 100, the developing unit 5 is attached through the main opening 102 to the inside of the apparatus main body 100 in a detachable manner.

Meanwhile, the accuracy of the position of the developing roller 51 with respect to the photoconductor drum 41 has a great influence on the image quality. In a case where the drum unit 4 and the developing unit 5 are individually attached to the apparatus main body 100, the error of the position of the developing roller 51 with respect to the photoconductor drum 41 may be increased by a combination of errors of positions of the drum unit 4 and the developing unit 5 in the apparatus main body 100.

On the other hand, the image forming apparatus 10 has a structure to enhance the accuracy of the attachment position of the developing roller 51 with respect to the photoconductor drum 41.

Figure 11:
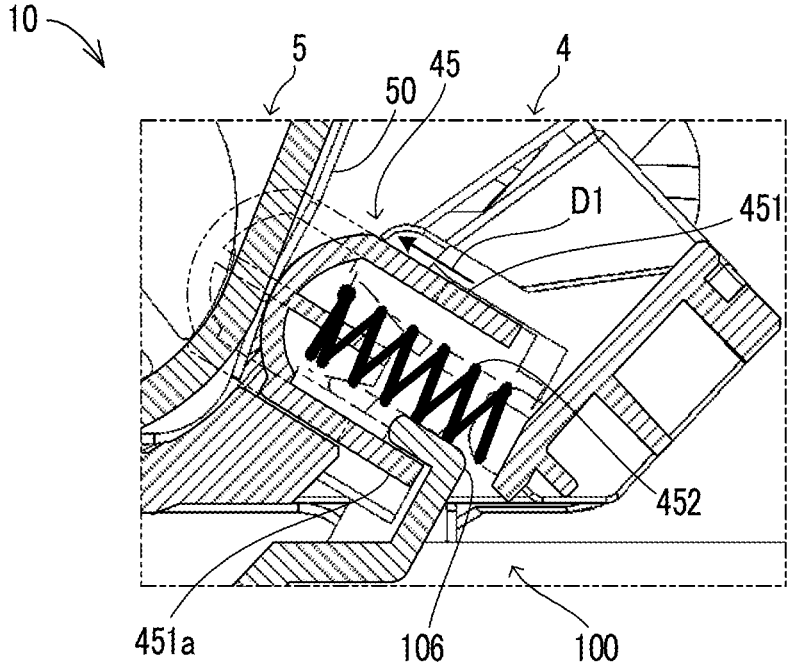
FIG. 11 is a cross-section diagram of a biasing mechanism and its surroundings in the image forming apparatus according to the embodiment.

In addition, the image forming apparatus 10 includes a biasing mechanism 45 configured to elastically bias the developing unit 5 toward the photoconductor drum 41 such that the developing roller 51 is held at a position close to the photoconductor drum 41 (see FIG. 7, FIG. 11). In addition, the developing unit 5 includes gears 53 and 54 configured to transmit a rotational force from a drive portion provided in the apparatus main body 100 to the developing roller 51 (see FIG. 12). In addition, a moment M1 of a force applied to the developing unit 5 via the gears 53 and 54 may act as a force that positionally shifts the developing unit 5 against the biasing force of the biasing mechanism 45 (see FIG. 12). The positional shift of the developing unit 5 has an adverse effect on the image quality.

The image forming apparatus 10 also has a structure to prevent the moment M1 of the force applied to the developing unit 5 from acting as a force that positionally shifts the developing unit 5 against the biasing force of the biasing mechanism 45.

In addition, the photoconductor drum 41 and the developing roller 51 are disposed close to each other. As a result, if the drum unit 4 and the developing unit 5 are removed by an erroneous procedure, the photoconductor drum 41 or the developing roller 51 may be damaged by coming in contact with a near member.

The image forming apparatus 10 also has a structure to prevent the drum unit 4 and the developing unit 5 from being removed by an erroneous procedure. The following describes structures of the drum unit 4 and the developing unit 5.

The first unit housing 40 of the drum unit 4 forms an attachment space 400 in which the developing unit 5 is disposed (see FIG. 5). The developing unit 5 is attached, in a detachable manner, to the first unit housing 40 of the drum unit 4 that has been attached to the apparatus main body 100.

That is, the developing unit 5 is attached to the apparatus main body 100 by being attached to the first unit housing 40 of the drum unit 4 that has been attached to the apparatus main body 100. In addition, the drum unit 4 can be removed from the apparatus main body 100 after the developing unit 5 is removed from the first unit housing 40 of the drum unit 4.

Figure 2:
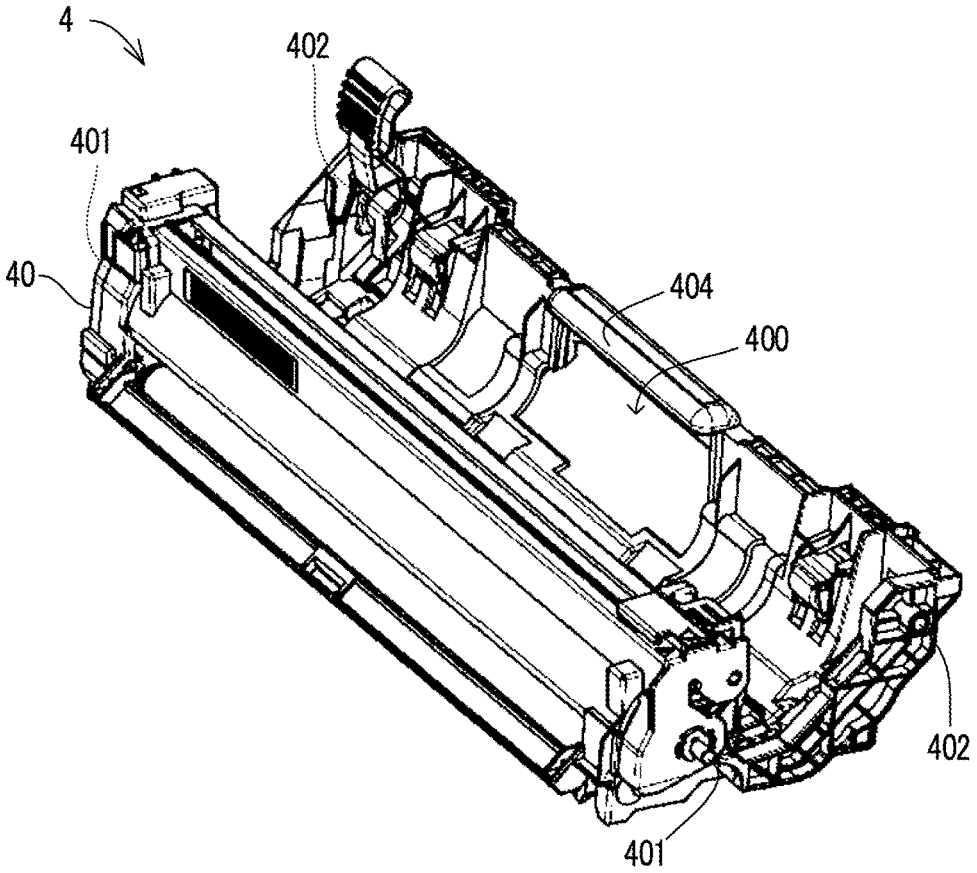
FIG. 2 is a perspective diagram of a drum unit in the image forming apparatus according to the embodiment.
Figure 12:
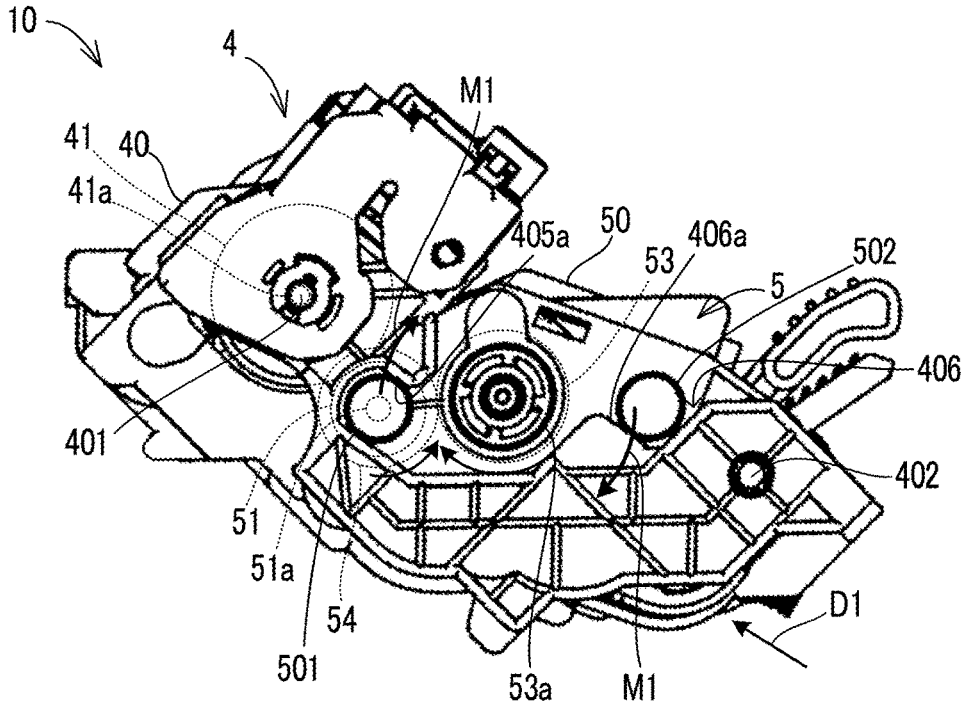
FIG. 12 is a side diagram of the drum unit and the developing unit in the image forming apparatus according to the embodiment.

As shown in FIG. 2, FIG. 4, and FIG. 12, the drum unit 4 includes a first drum unit projection 401 that projects out from opposite sides of the drum unit 4 along an extension line of the rotation shaft 41*a* of the photoconductor drum 41. Furthermore, the drum unit 4 includes a second drum unit projection 402 that projects out from the opposite sides of the drum unit 4 in parallel to the first drum unit projection 401.

Figure 8:
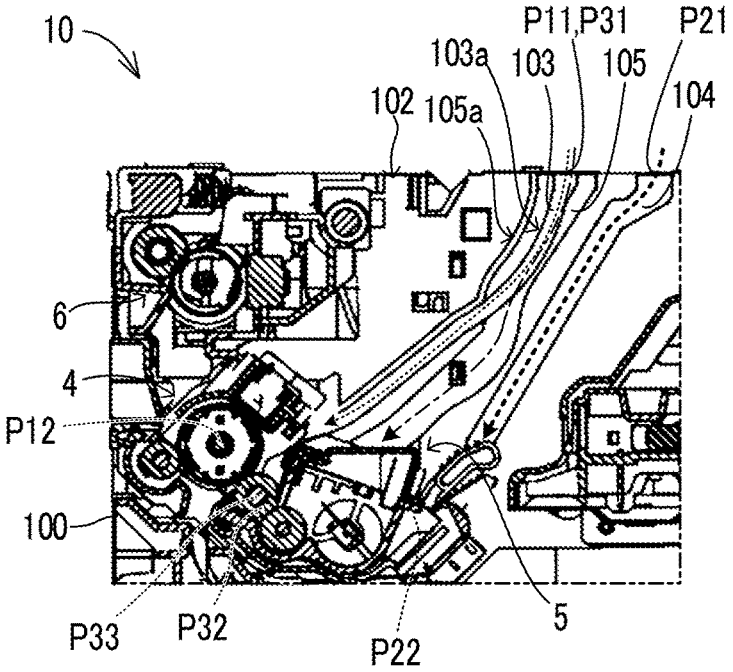
FIG. 8 is a cross-section diagram of a portion including a drum projection guide portion and a developing projection guide portion in the image forming apparatus according to the embodiment.

As shown in FIG. 1 and FIG. 8, the apparatus main body 100 includes a first drum projection guide portion 103 and a second drum projection guide portion 104 that are provided on inner surfaces of a pair of side walls facing each other. The first drum projection guide portion 103 and the second drum projection guide portion 104 are provided as a structure for facilitating the attachment of the drum unit 4.

The first drum projection guide portion 103 is a guide rail configured to guide the first drum unit projection 401 from a first drum introduction position P11 to a first drum attachment position P12 in the apparatus main body 100.

The second drum projection guide portion 104 is a guide rail configured to guide the second drum unit projection 402 from a second drum introduction position P21 to a second drum attachment position P22 in the apparatus main body 100.

The first drum introduction position P11 and the second drum introduction position P21 are located along the main opening 102 in the apparatus main body 100. In addition, the first drum attachment position P12 is located further away from the main opening 102 than the first drum introduction position P11. Similarly, the second drum attachment position P22 is located further away from the main opening 102 than the second drum introduction position P21.

When the first drum unit projection 401 is located at the first drum attachment position P12, and the second drum unit projection 402 is located at the second drum attachment position P22, the drum unit 4 is in a state of being correctly attached to the apparatus main body 100.

Figure 3:
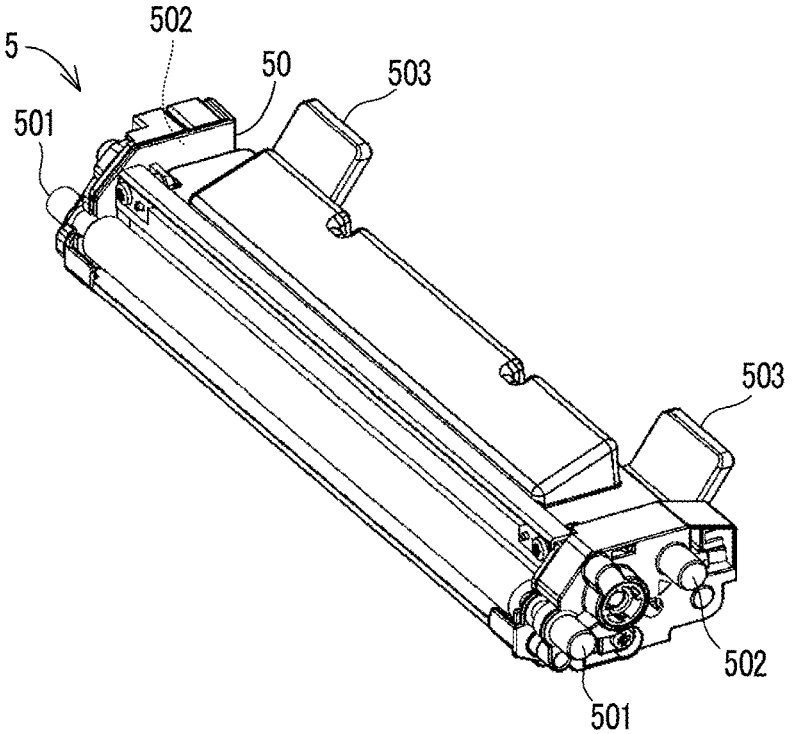
FIG. 3 is a perspective diagram of a developing unit in the image forming apparatus according to the embodiment.

As shown in FIG. 3, FIG. 4, and FIG. 12, the second unit housing 50 of the developing unit 5 includes a first developing unit projection 501 and a second developing unit projection 502. The first developing unit projection 501 is formed to project out from opposite sides of the developing unit 5 along an extension line of the rotation shaft 51*a* of the developing roller 51. The second developing unit projection 502 is formed to project out from the opposite sides in parallel to the first developing unit projection 501.

As shown in FIG. 1 and FIG. 8, the apparatus main body 100 includes a first developing projection guide portion 105 that is provided on inner surfaces of a pair of side walls facing each other. Furthermore, the first unit housing 40 of the drum unit 4 includes a second developing projection guide portion 405 that is formed on opposite side plates of the attachment space 400. The first developing projection guide portion 105 and the second developing projection guide portion 405 are provided as a structure for facilitating the attachment of the developing unit 5.

Figure 10:
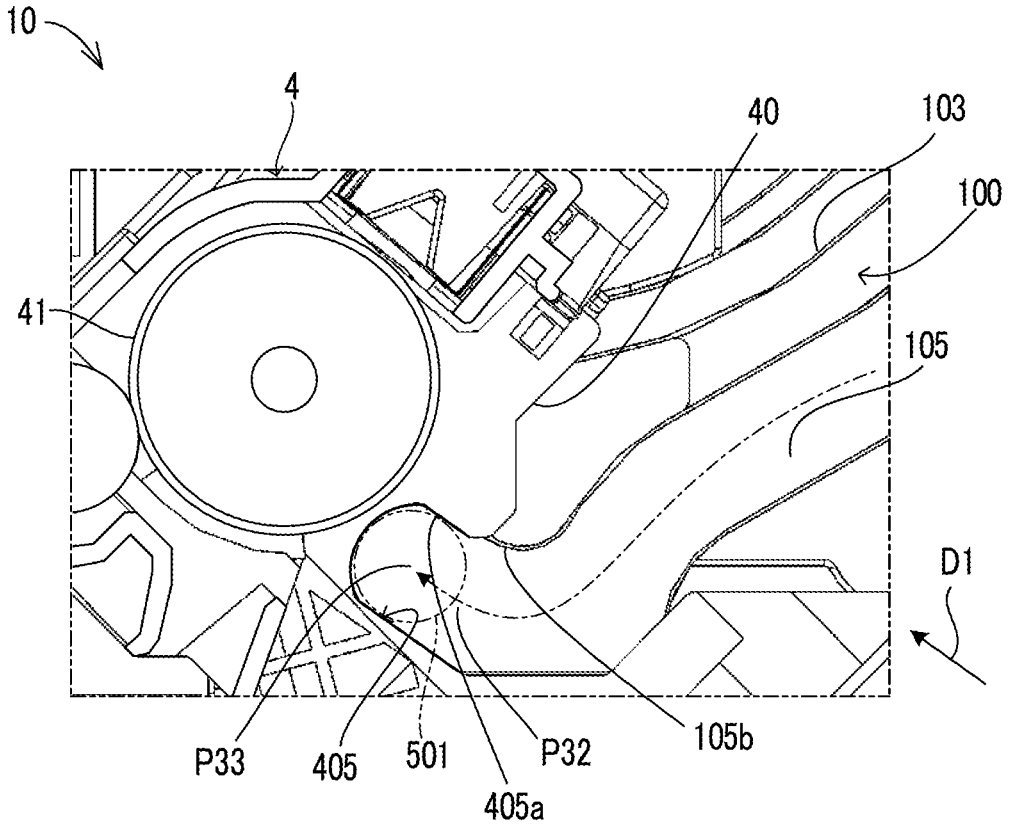
FIG. 10 is a diagram showing an end portion of a first developing projection guide portion and a second developing projection guide portion in the image forming apparatus according to the embodiment.

As shown in FIG. 8 and FIG. 10, the first developing projection guide portion 105 includes a guide rail 105*a* configured to guide the first developing unit projection 501 from a developing unit introduction position P31 to a relay position P32 in the apparatus main body 100. The developing unit introduction position P31 is located along the main opening 102 in the apparatus main body 100. The relay position P32 is located closer to the photoconductor drum 41 than the developing unit introduction position P31.

Furthermore, the first developing projection guide portion 105 guides the second developing unit projection 502. The first developing projection guide portion 105 guides both the first developing unit projection 501 and the second developing unit projection 502 and thereby stabilizes the attitude of the developing unit 5 during the detachment.

As shown in FIG. 10, the second developing projection guide portion 405 is disposed inside the attachment space 400 to face a downstream end portion 105*b* of the guide rail 105*a*, and succeeding from the first developing projection guide portion 105, guides the first developing unit projection 501 from the relay position P32 to a developing unit attachment position P33. The developing unit attachment position P33 is closer to the photoconductor drum 41 than the relay position P32.

The second developing projection guide portion 405 is formed in a recessed shape at the developing unit attachment position P33 such that the first developing unit projection 501 is fitted to the second developing projection guide portion 405. The first developing unit projection 501 is positioned by the second developing projection guide portion 405.

In the present embodiment, the first developing unit projection 501 is guided by the second developing projection guide portion 405 of the drum unit 4 to the developing unit attachment position P33. This makes it possible for the developing roller 51 to be positioned with high accuracy with respect to the photoconductor drum 41 without being influenced by an error of the position of the developing unit 5 in the apparatus main body 100.

The first drum unit projection 401 is formed to project further than the first developing unit projection 501 from the opposite sides, and be thinner than the first developing unit projection 501. In other words, the first drum unit projection 401 is formed to project, from the opposite sides, to positions that are not reached by tips of the first developing unit projection 501, and the first developing unit projection 501 is thicker than the first drum unit projection 401.

Figure 9:
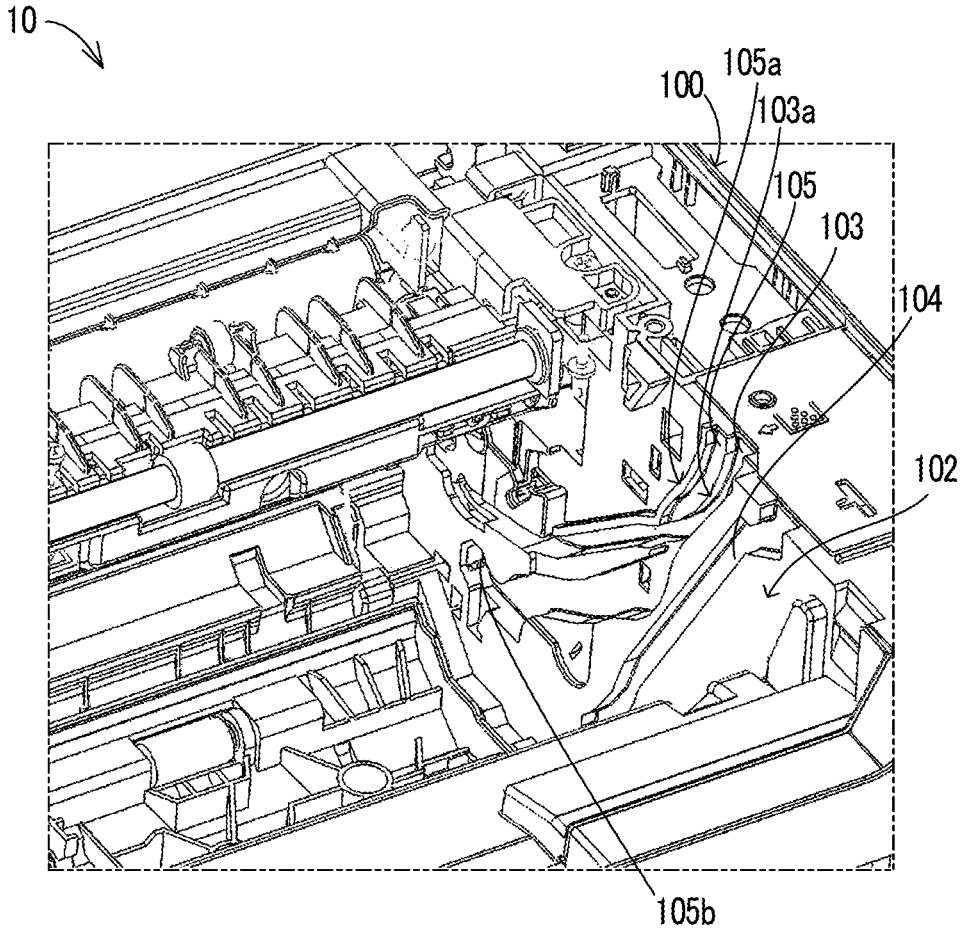
FIG. 9 is a perspective diagram of a portion including the drum projection guide portion and the developing projection guide portion in the image forming apparatus according to the embodiment.

In addition, a partial path of the first drum projection guide portion 103 overlaps with a partial path of the first developing projection guide portion 105 to form a guide path 103*a* (see FIG. 8, FIG. 9).

In the present embodiment, a partial path of the first drum projection guide portion 103 including the first drum introduction position P11 overlaps with a partial path of the first developing projection guide portion 105 including the developing unit introduction position P31.

In addition, the first drum projection guide portion 103 forms, at outside the first developing projection guide portion 105, a guide path that is narrower in width than the first developing projection guide portion 105. Here, the outside is the opposite side to a region in which the photoconductor drum 41 and the developing roller 51 are disposed, in a direction along the rotation shaft 41*a* of the photoconductor drum 41 and the rotation shaft 51*a* of the developing roller 51.

In the present embodiment, each of the first drum projection guide portion 103 and the first developing projection guide portion 105 is formed to be a groove (see FIG. 9). The first drum projection guide portion 103 is a groove that is narrower in width and deeper than the first developing projection guide portion 105.

As a result, the partial path of the first drum projection guide portion 103 overlapping with the first developing projection guide portion 105 is a groove that is narrow in width, deep, and formed in a groove of the first developing projection guide portion 105 (see FIG. 9).

Furthermore, the first unit housing 40 of the drum unit 4 includes a projection support portion 406 that supports the second developing unit projection 502 (see FIG. 12).

When the developing unit 5 is attached to the drum unit 4, the first developing unit projection 501 is guided to the developing unit attachment position P33 by the first drum projection guide portion 103 and the first developing projection guide portion 105, and the second developing unit projection 502 is placed to the projection support portion 406. With this, the developing unit 5 is attached to the drum unit 4.

The photoconductor drum 41 and the developing roller 51 are disposed close to each other in the apparatus main body 100. As a result, there may be a case where a partial path of the first drum projection guide portion 103 needs to be overlapped with a partial path of the first developing projection guide portion 105. The present embodiment is applicable to such a case.

As shown in FIG. 7 and FIG. 11, the drum unit 4 further includes the biasing mechanism 45. The biasing mechanism 45 elastically biases the developing unit 5 in a predetermined biasing direction D1. The biasing direction D1 is a direction in which the first developing unit projection 501 moves from the relay position P32 to the developing unit attachment position P33. That is, the biasing mechanism 45 elastically biases the biasing mechanism 45 toward the photoconductor drum 41.

It is noted that the developing unit introduction position P31 is an example of a first start position, and the developing unit attachment position P33 is an example of a first end position. In addition, the first drum introduction position P11 is an example of a second start position, and the first drum attachment position P12 is an example of a second end position.

As shown in FIG. 12, the developing unit 5 further includes a primary gear 53 and a secondary gear 54. A coupling 53*a* is formed on a side of the primary gear 53, and the apparatus main body 100 is provided with a drive portion that is engaged with the coupling 53*a*. The primary gear 53 is a pinion gear to which a rotational force is transmitted from the drive portion via the coupling 53*a*.

The secondary gear 54 is a pinion gear that is integrally formed with the rotation shaft 51*a* of the developing roller 51. A rotational force is transmitted from the primary gear 53 to the secondary gear 54. The secondary gear 54 is rotatably supported by the second unit housing 50.

As shown in FIG. 12, in a state where the developing unit 5 has been attached to the drum unit 4, the second developing unit projection 502 is on the opposite side to the first developing unit projection 501 with respect to the primary gear 53.

When the primary gear 53 is rotationally driven, the moment M1 of the force is applied from the primary gear 53 to the developing unit 5 via the secondary gear 54 (see FIG. 12).

The second developing projection guide portion 405 includes a first support surface 405*a* that supports the first developing unit projection 501 against the moment M1 of the force (see FIG. 5, FIG. 10, FIG. 12). The first support surface 405*a* is parallel to the biasing direction D1 of the biasing mechanism 45.

In addition, the projection support portion 406 includes a second support surface 406*a* that supports the second developing unit projection 502 against the moment M1 of the force (see FIG. 12). As is the case with the first support surface 405*a*, the second support surface 406*a* is parallel to the biasing direction Dl.

Since the first support surface 405*a* and the second support surface 406*a* are parallel to the biasing direction D1, the moment M1 of the force acts on the first support surface 405*a* and the second support surface 406*a* in a direction perpendicular to the biasing direction D1.

Accordingly, it is avoided that the moment M1 of the force acts as a force that causes the developing unit 5 to positionally shift against the biasing force of the biasing mechanism 45. As a result, the developing roller 51 is held with high positional accuracy with respect to the photoconductor drum 41.

As shown in FIG. 2 and FIG. 5, the first unit housing 40 of the drum unit 4 includes a first handle portion 404. The first handle portion 404 is gripped by a hand of a worker when the drum unit 4 is attached to the apparatus main body 100, or when the drum unit 4 is removed from the apparatus main body 100.

The first handle portion 404 is configured to be gripped by a hand that accesses it through the attachment space 400. In other words, when the attachment space 400 is closed, the first handle portion 404 cannot be gripped.

As shown in FIG. 3 and FIG. 4, the second unit housing 50 of the developing unit 5 includes a second handle portion 503. The second handle portion 503 is gripped by a hand of a worker when the developing unit 5 is attached to the drum unit 4, or when the developing unit 5 is removed from the drum unit 4.

As shown in FIG. 4 and FIG. 6, by being attached to the drum unit 4, the developing unit 5 closes a path including the attachment space 400 through which the first handle portion 404 is accessed by the hand. Accordingly, it is possible to avoid an erroneous operation of lifting the drum unit 4 before the developing unit 5 is removed from the drum unit 4.

The structure of the first handle portion 404 prevents the photoconductor drum 41 or the developing roller 51 from being damaged due to lifting of the drum unit 4 before the separation of the developing roller 51 from the photoconductor drum 41.

As shown in FIG. 11, the biasing mechanism 45 includes an abutting member 451 and a spring 452. The abutting member 451 is supported in such a way as to be displaced between a predetermined reference position and an action position, wherein the action position is further away from the photoconductor drum 41 than the reference position.

In FIG. 11, the abutting member 451 located at the reference position is indicated by an imaginary line (a two-dot chain line), and the abutting member 451 located at the action position is indicated by a solid line. The biasing direction D1 matches a direction in which the abutting member 451 moves from the action position to the reference position.

The abutting member 451 abuts on the developing unit 5 attached to the drum unit 4, and thereby is displaced from the reference position to the action position.

The spring 452 elastically biases the abutting member 451 toward the photoconductor drum 41. This allows the spring 452 to bias the developing unit 5 toward the photoconductor drum 41 via the abutting member 451. The spring 452 is an example of an elastic member. It is noted that rubber may be adopted instead of the spring 452.

On the other hand, the apparatus main body 100 includes a locking portion 106 that is configured to lock a locked portion 451*a* of the abutting member 451. The locking portion 106 locks the abutting member 451 located at the action position, thereby restricting the drum unit 4 from moving in a direction of being removed from the apparatus main body 100.

When the abutting member 451 is displaced from the action position to the reference position by the biasing force of the spring 452, the locking of the abutting member 451 by the locking portion 106 is released.

The structure where the locking portion 106 locks the abutting member 451 prevents, in a more reliable manner, the photoconductor drum 41 or the developing roller 51 from being damaged due to lifting of the drum unit 4 before the separation of the developing roller 51 from the photoconductor drum 41.

[Application Example]

Figure 13:
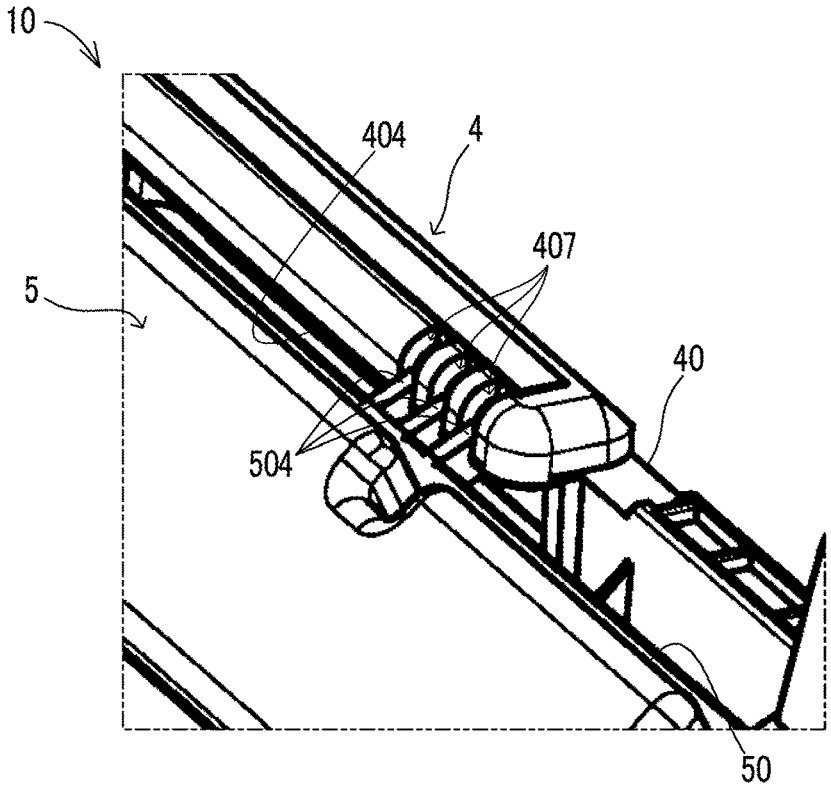
FIG. 13 is a perspective diagram of fitting portions provided in a drum unit and a developing unit in an application example of the image forming apparatus according to the embodiment.

Next, the following describes the drum unit 4 and the developing unit 5 according to an application example applicable to the image forming apparatus 10 with reference to FIG. 13. In the present application example, the drum unit 4 and the developing unit 5 include fitting portions 407 and 504 shown in FIG. 13.

Specifically, the first unit housing 40 of the drum unit 4 includes one or more fitting recessed portions 407 of a recessed shape, and the second unit housing 50 of the developing unit 5 includes one or more fitting projection portions 504 of a projecting shape.

In the example shown in FIG. 13, three fitting recessed portions 407 are formed in the first handle portion 404. In addition, three fitting projection portions 504 are formed in the second unit housing 50 in correspondence with the three fitting recessed portions 407.

The fitting projection portions 504 are configured to be fitted to the fitting recessed portions 407 only when the developing unit 5 is attached to the drum unit 4 in a predetermined normal direction. The fitting projection portions 504 prevent the developing unit 5 from being attached to the drum unit 4 in a direction other than the normal direction.

That is, when an attempt is made to attach the developing unit 5 to the drum unit 4 in a direction other than the normal direction, the fitting projection portions 504 are caught by any part of the drum unit 4, and the developing unit 5 is not completely stored in the attachment space 400 of the drum unit 4.

The fitting recessed portions 407 and the fitting projection portions 504 prevent the developing unit 5 from being attached to the drum unit 4 in an incomplete state.

It is noted that the second unit housing 50 of the developing unit 5 may include one or more fitting recessed portions 407, and the first unit housing 40 of the drum unit 4 may include one or more fitting projection portions 504.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body having an opening that is closed by a cover portion;

a drum unit including a rotatably supported photoconductor drum and attached through the opening to an inside of the apparatus main body in a detachable manner; and a developing unit including a rotatably supported developing roller and a developing unit projection and attached to the drum unit in a detachable manner, the developing unit projection being formed to project out from opposite sides of the developing unit along an extension line of a rotation shaft of the developing roller, wherein the apparatus main body includes a first developing projection guide portion configured to guide the developing unit projection from a first start position to a relay position in the apparatus main body, the relay position located closer to the photoconductor drum than the first start position, the drum unit further includes a drum unit projection formed to project out from opposite sides of the drum unit along an extension line of a rotation shaft of the photoconductor drum, the apparatus main body includes a drum projection guide portion configured to guide the drum unit projection from a second start position to a second end position in the apparatus main body, the second end position located further away from the opening than the second start position, the drum unit projection is formed to project out further than the developing unit projection from the opposite sides and be thinner than the developing unit projection, and a partial path of the drum projection guide portion overlaps with a partial path of the first developing projection guide portion, and the first drum projection guide portion forms, at outside the first developing projection guide portion, a guide path that is narrower in width than the first developing projection guide portion.

2. The image forming apparatus according to claim 1, wherein the drum unit further includes a biasing mechanism that elastically biases the developing unit in a direction in which the developing unit projection moves from the relay position to a first end position, the first end position located closer to the photoconductor drum than the relay position.

3. The image forming apparatus according to claim 1, wherein the drum unit further includes a second developing projection guide portion configured to, succeeding from the first developing projection guide portion, guide the developing unit projection from the relay position to a first end position, the first end position located closer to the photoconductor drum than the relay position.

4. An image forming apparatus comprising:

a drum unit provided in an apparatus main body and including a rotatably supported photoconductor drum; and a developing unit including a rotatably supported developing roller, a primary gear, and a secondary gear and configured to be attached to the drum unit, the primary gear receiving a rotational force from a drive portion provided in the apparatus main body, the secondary gear being integrally provided with a rotation shaft of the developing roller and receiving a rotational force from the primary gear; and a biasing mechanism that elastically biases the developing unit toward the photoconductor drum, wherein the developing unit includes:

a first developing unit projection formed to project out from opposite sides of the developing unit along an extension line of a rotation shaft of the developing roller; and a second developing unit projection provided on an opposite side to the first developing unit projection with respect to the primary gear in a state where the developing unit has been attached to the drum unit, the second developing unit projection projecting out from the opposite sides in parallel to the first developing unit projection, and the drum unit includes:

a first support surface that supports the first developing unit projection against a moment of a force that is applied from the primary gear to the developing unit via the secondary gear, the first support surface being parallel to a biasing direction of the biasing mechanism; and a second support surface that supports the second developing unit projection against the moment of the force, the second support surface being parallel to the biasing direction.

5. The image forming apparatus according to claim 4, wherein the apparatus main body includes a first developing projection guide portion configured to guide the first developing unit projection from a first start position to a relay position in the apparatus main body, the relay position located closer to the photoconductor drum than the first start position, the drum unit includes a second developing projection guide portion configured to, succeeding from the first developing projection guide portion, guide the first developing unit projection from the relay position to a first end position along the first support surface, the first end position located closer to the photoconductor drum than the relay position, and the second developing projection guide portion includes the first support surface.

6. The image forming apparatus according to claim 4, wherein the biasing mechanism is provided in the drum unit.

7. An image forming apparatus comprising:

an apparatus main body having an opening that is closed by a cover portion;

a drum unit including a rotatably supported photoconductor drum and attached through the opening to the apparatus main body in a detachable manner; and a developing unit including a rotatably supported developing roller and attached to the drum unit in a detachable manner, wherein the drum unit includes:

an abutting member supported in such a way as to be displaced between a reference position and an action position that is further away from the photoconductor drum than the reference position, the abutting member abutting on the developing unit attached to the drum unit to be displaced from the reference position to the action position; and an elastic member that elastically biases the abutting member toward the photoconductor drum, and thereby biases the developing unit toward the photoconductor drum via the abutting member, and the apparatus main body includes a locking portion configured to lock the abutting member located at the action position, thereby restricting the drum unit from moving in a direction of being removed from the apparatus main body, wherein a locking of the abutting member by the locking portion is released, when the abutting member is displaced to the reference position by a biasing force of the elastic member.

8. The image forming apparatus according to claim 7, wherein the drum unit forms an attachment space in which the developing unit is disposed, and includes a handle portion configured to be gripped by a hand that accesses the handle portion through the attachment space, and by being attached to the drum unit, the developing unit closes a path including the attachment space through which the handle portion is accessed by the hand.

9. The image forming apparatus according to claim 7, wherein one of the drum unit and the developing unit includes a fitting recessed portion of a recessed shape, and the other of the drum unit and the developing unit includes a fitting projection portion configured to be fitted to the fitting recessed portion only when the developing unit is attached to the drum unit in a predetermined normal direction, thereby preventing the developing unit from being attached to the drum unit in a direction other than the normal direction.

* * * * *